United States Patent [19]

Meyer

[11] 4,346,273

[45] Aug. 24, 1982

[54] CIRCUIT-INTERRUPTER HAVING A HIGH-FREQUENCY TRANSVERSE MAGNETIC FIELD TO ASSIST IN ARC INTERRUPTION

[75] Inventor: Thomas N. Meyer, Murrysville, Pa.

[73] Assignee: Westinghouse Electric Corp., Pittsburgh, Pa.

[21] Appl. No.: 102,045

[22] Filed: Dec. 10, 1979

[51] Int. Cl.[3] ..... H01H 33/18; H01H 33/88

[52] U.S. Cl. ..... 200/147 R; 200/148 A

[58] Field of Search ..... 200/147 R, 148 A

[56] References Cited

U.S. PATENT DOCUMENTS

| | | | |
|---|---|---|---|
| 4,021,628 | 5/1977 | Kimblin | 200/147 R |
| 4,032,736 | 6/1977 | Ruffieux et al. | 200/147 R |
| 4,139,751 | 2/1979 | Rostron et al. | 200/148 A |
| 4,151,391 | 4/1979 | Rolff et al. | 200/147 R |
| 4,160,140 | 7/1979 | Rolff | 200/147 R |
| 4,206,330 | 6/1980 | McConnell et al. | 200/147 R |
| 4,250,364 | 2/1981 | Kimblin et al. | 200/147 R |

FOREIGN PATENT DOCUMENTS

| | | | |
|---|---|---|---|
| 1166324 | 3/1964 | Fed. Rep. of Germany | 200/147 R |
| 1186125 | 1/1965 | Fed. Rep. of Germany | 200/147 R |
| 1207988 | 12/1965 | Fed. Rep. of Germany | 200/147 R |

*Primary Examiner*—Robert S. Macon

*Attorney, Agent, or Firm*—L. P. Johns

[57] ABSTRACT

An improved circuit-interrupter is provided having a high-frequency transverse magnetic field to assist in the very rapid interruption of the arc, which is established during operation of the device, said magnetic field being preferably of the three-phase type and rotating, having three separate field coils energized by a transitory, high-frequency power source to result in an interaction between the arc column and the transversely-oriented, high-frequency, multi-phase magnetic field of transitory duration to thereby afford a more intimate interaction with the arc-extinguishing medium, which may be gaseous, for example.

7 Claims, 12 Drawing Figures

CLOSED POSITION

FULLY OPEN POSITION

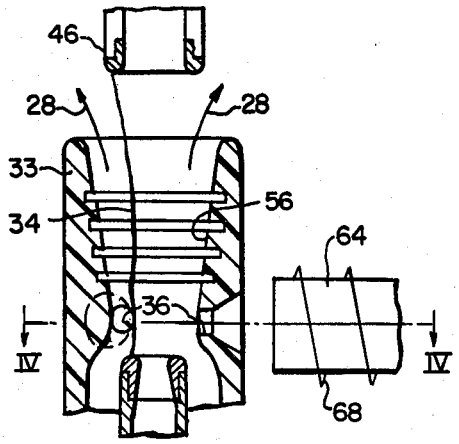
FIG. 3.
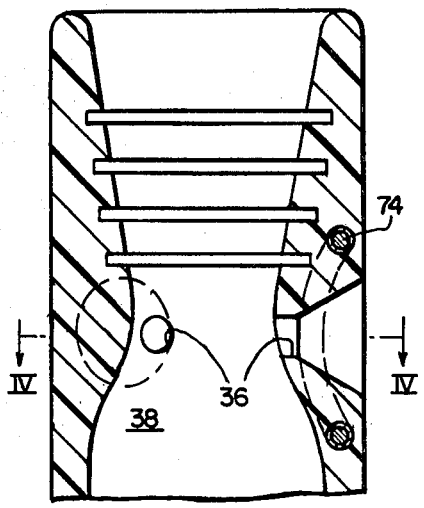
FIG. 5.
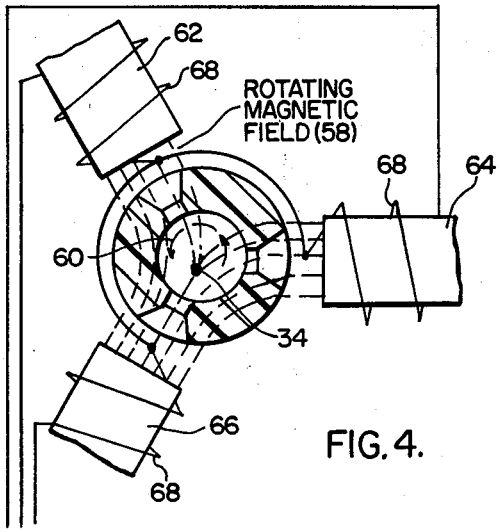
FIG. 4.
FIG. 6.
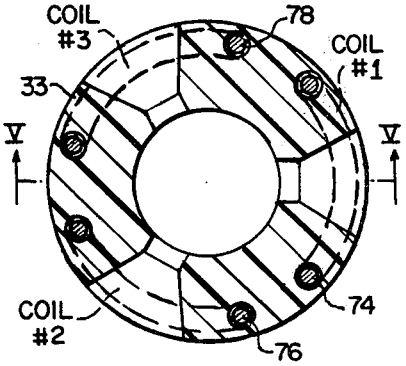

CIRCUIT-INTERRUPTER HAVING A HIGH-FREQUENCY TRANSVERSE MAGNETIC FIELD TO ASSIST IN ARC INTERRUPTION

BACKGROUND OF THE INVENTION

In conventional gas-blast circuit-breakers a high degree of turbulence is considered essential for rapid current interruption. Turbulence increases the arc heat losses, and these heat losses lead to a more constricted, or smaller arc; and a smaller arc can dielectrically recover much more quickly leading to its extinction.

Those skilled in the art of circuit interruption are well aware of many circuit-interrupting devices which utilize a rotating magnetic field to cause rotation of the arc column about the separable contacts. This gives rise to a greater interaction between the arc itself and the surrounding arc-extinguishing ambient, which may be a gas-blast, projected by suitable compressing means, through an orifice opening. Reference is made to U.S. patents: Wilson, U.S. Pat. No. 3,716,685, issued Feb. 13, 1973; Beatty et al., U.S. Pat. No. 3,418,440, issued Dec. 24, 1968; Robinson et al., U.S. Pat. No. 3,469,050, issued Sept. 23, 1969; and Beatty, U.S. Pat. No. 3,274,365, issued Sept. 20, 1966, as typical examples of the application of radial magnetic field coils, which effect a rotative travel of an established arc during interruption. In addition, reference is made to Stone, U.S. Pat. No. 2,166,828, issued July 18, 1939, which illustrates the interaction of a direct-current magnetic field acting upon an alternating-current power arc resulting in an oscillating movement of the established arc in the Stone device and its consequent interruption.

Also of interest is Joseph Slepian, U.S. Pat. No. 2,103,121, issued Dec. 21, 1937, which shows a series field-coil, electrically connected in series with the circuit-interrupting contacts and effecting a consequent rotation of the established arc between a pair of tubular, cooperable, relatively-movable contacts, while at the same time utilizing a gas-blast to assist in arc interruption.

It will, however, be noted that the aforesaid circuit-interrupting structures, as exemplified by the foregoing patents, do not use a transitory high-frequency magnetic field, with which the present invention is particularly concerned.

BRIEF SUMMARY OF THE INVENTION

In accordance with the present invention, there is provided an improved circuit-interrupter, which has associated therewith a transitory, high-frequency, transverse, magnetic field of short duration, which comes into operative play only at the time of arc interruption. The source of power for the high-frequency, transverse, magnetic field is separate, distinct and isolated from the usual power-source generating the power-current, which passes through the circuit-interrupting contacts themselves. Means are provided, such as, for example, the break-down of a spark-gap to momentarily bring into play a high-frequency, transverse, magnetic field of transitory duration acting upon the arc column to thereby increase the turbulence resulting from arc movement within the surrounding ambient of the arc-extinguishing medium, which, for example, may be a longitudinal gas-blast.

In one particular embodiment of the present invention, there is provided a three-phase, transverse, magnetic field coil structure to cause a longitudinal oscillating movement of the arc column. In still another embodiment of the present invention, there is provided a multi-phase, rotating, high-frequency, magnetic field to effect thereby a rotative travel of the arc column within a nozzle orifice, through which, preferably, an arc-extinguishing gaseous medium is caused to flow. This latter-mentioned structure is particularly desirable in the commonly-used, commercial, puffer-type, circuit-interrupter, which generates its own blast of compressed gas by the relative interaction between a cooperable piston and operating cylinder structure.

Still another embodiment of the present invention contemplates the utilization of three magnetic field coils embedded, for example, in the movable nozzle structure of a puffer-type circuit-interrupter, in which the electrical leads for the three field-coils are connected to a separate remote power source of limited transitory operation. Such a source may include, for example, a capacitor charged by a high-voltage, low-power source and triggered by a spark-gap at the appropriate desired time during circuit interruption.

BRIEF DESCRIPTION OF THE DRAWINGS

FIG. 3 is a diagrammatic vertical sectional view through an insulating nozzle structure of the circuit interrupter showing the location and configuration of a confined arc column extending between separated electrodes and indicating the direction of the gas blast;

FIG. 4 is a diagrammatic view on the line IV—IV of FIG. 3 illustrating the circle of arc rotation as a result of a rotating transverse, high frequency, three-phase magnetic field interacting with the arc column and energized from a separate high frequency, three-phase, pulse, power supply;

FIG. 5 is an enlarged vertical sectional view, taken through the movable hollow nozzle structure of FIG. 2, illustrating the location of one of the high frequency magnetic field-coils;

FIG. 6 is a horizontal sectional view taken on the line VI—VI of FIG. 5;

DESCRIPTION OF THE PREFERRED EMBODIMENT

Figure 1:
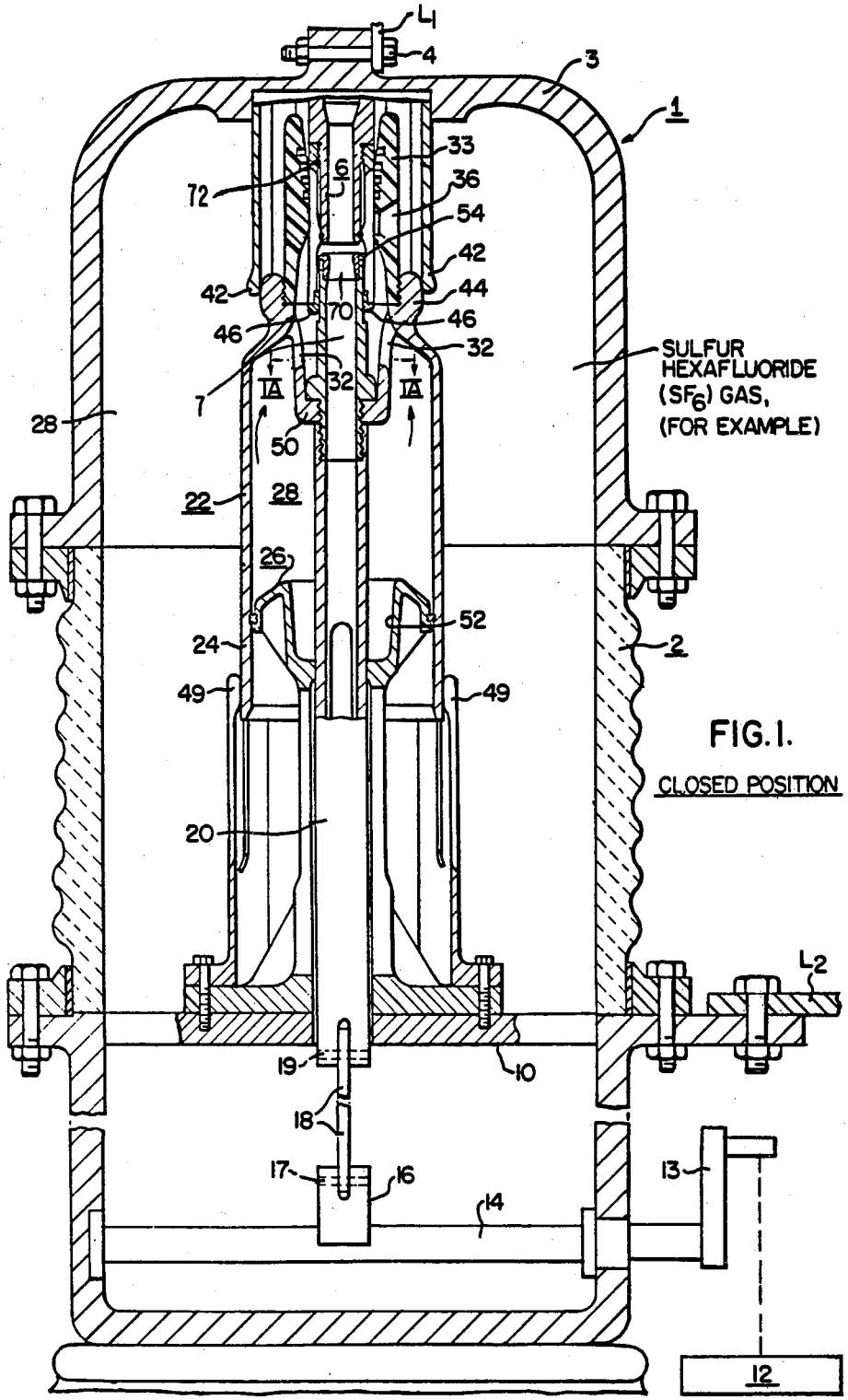
FIG. 1 is a vertical sectional view showing a gas blast, puffer type circuit interrupter in the closed position.

In FIG. 1 a circuit interrupter is generally indicated at 1 and it comprises an insulating casing 2 which supports an upper conducting cap 3 which is connected by a bolt 4 to a line terminal $L_1$. A stationary contact structure 6 which is cooperable with a movable contact structure 7. The movable contact structure is electrically connected by a movable operating cylinder assembly 22 and a plurality of sliding ring contacts 49 to a conducting support plate 10 which is horizontally disposed and connected to a second line terminal $L_2$ externally of the casing 2.

A suitable operating mechanism 12 (FIG. 1) of conventional form effects rotation of an externally-provided crank-arm 13 for the opening and closing rotative motions of an internally-disposed operating shaft 14. The shaft 14 is fixedly connected to an internally disposed rotative crank arm 16 which is pivotally connected at 17 to a link 18 which in turn is pivoted at 19 to the lower end of a linearly movable contact operating rod 20. The upper end of the contact operating rod 20 comprises the movable contact structure 7 which is movable between open and closed circuit positions with the stationary contact structure 6.

Figure 1A:
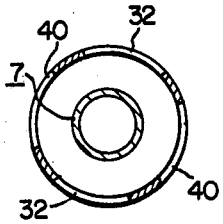
FIG. 1A is a horizontal sectional view taken generally on the line IA—IA of FIG. 2.

The movable operating cylinder assembly 22 comprises a large diameter, downwardly extending movable sleeve portion 24 which slidably moves over a relatively fixed piston structure 26. During opening operation the movable operating cylinder 22 moves downwardly over the piston structure 26 to compress gas 28 within the cylinder assembly 22, thereby forcing it to flow upwardly through vent openings 32 (FIGS. 1 and 1A) and through a relatively short nozzle 33 through which an arc 34 (FIG. 2) is drawn between the upper end of the movable contact structure 7 and the stationary contact structure 6.

The nozzle 33 (FIG. 5) comprises a plurality of vent openings 36 to enable hot arc gases to quickly vent from the arcing region 38 to facilitate cooling action. Reference is made to U.S. Pat. No. 3,291,948. The movable operating cylinder assembly 22 comprises a wide venting area 40 (FIG. 1A) having vent openings 32 to provide unimpeded flow of compressed gas 28 from the compartment 30 upwardly through the vent openings 32 and into the nozzle structure 33 for extinguishing the arc 34.

Figure 2:
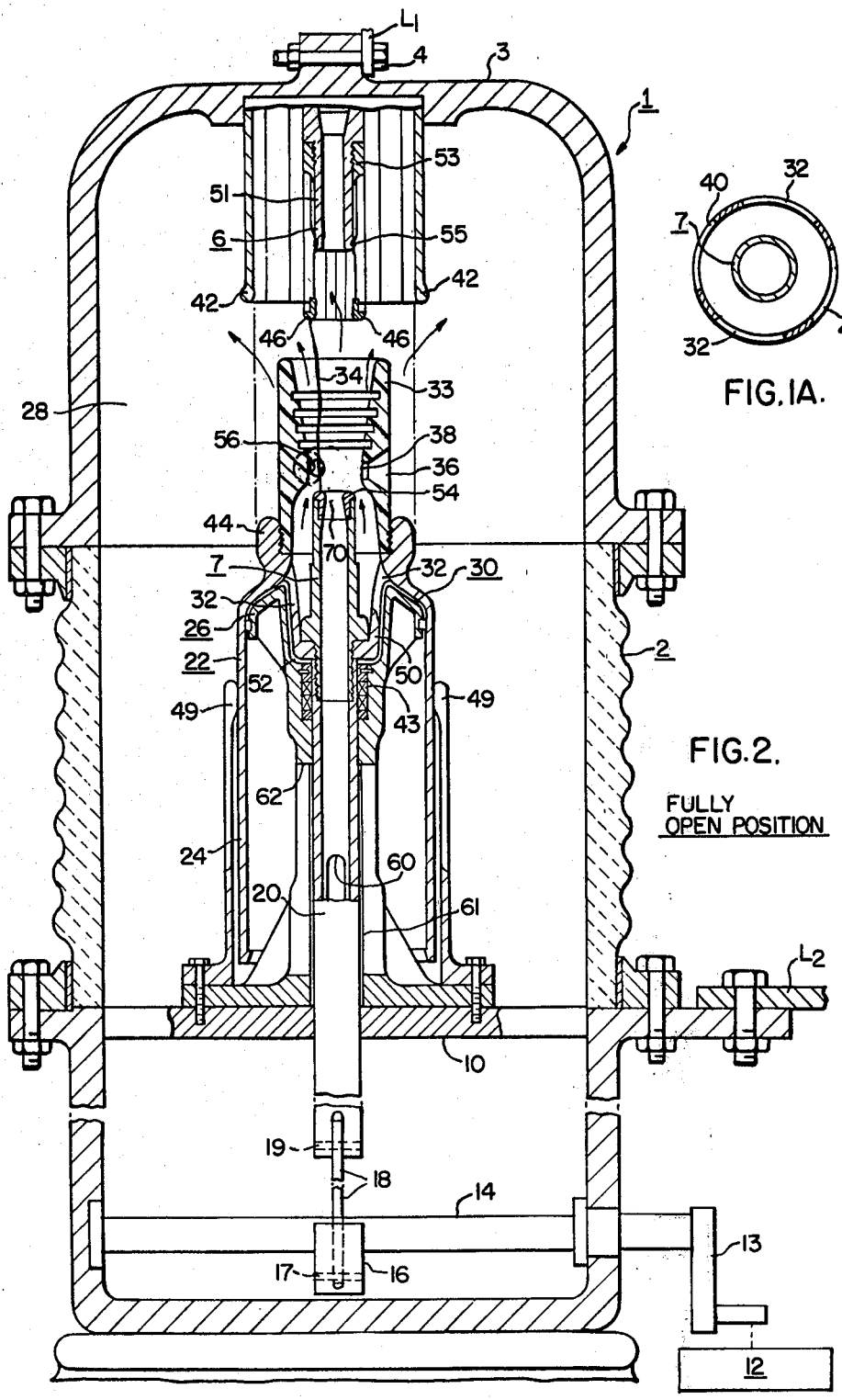
FIG. 2 is a view similar to FIG. 1 with the device in the fully open position.

A plurality of stationary contact fingers 42 make contacting engagement in the closed circuit position (FIG. 1) with an annular main movable contact portion 44 at the upper end of the cylinder assembly 22. During the opening operation the main stationary contact fingers 42 (FIG. 2) separate from the annular movable main contacting portion 44, whereby contact is only maintained between a plurality of stationary arcing contact fingers 46 and a movable arcing contact 54 (FIGS. 1 and 2).

Continued opening motion of the operating rod 20 moves the movable operating cylinder 22 downwardly over the stationary piston structure 26 to provide an upward flow of the compressed gas through the movable nozzle 33. A movable boss portion 50 of the cylinder assembly enters a stationary cavity 52 provided generally centrally of the piston structure 26 and thereby provides a mating closing interengagement between the two structures to minimize the "dead" volume of gas within the assembly 28 (FIG. 2). This is desirable inasmuch as a higher gas-compression ratio is achieved.

During the closing operation of the contact structures the movable operating cylinder 22 moves upwardly together with the annular main movable contact 44. Contact is first made between the stationary arcing contact fingers 46 and the movable arcing contact 54, thereby preventing a subsequent pre-striking condition from occurring between the main stationary contact fingers 42 and the annular contact portion 44. Thus no arcing occurs at the main stationary contact fingers 42 and the annular movable contact 44. Any prestriking arcing is confined to the stationary arcing finger contacts 46 and the movable arcing contact 54 to prevent arc erosion from occurring at the main contacts. The gas flow path through the main operating cylinder 22 and the insulating nozzle 33 presents an efficiently shaped contour with steadily decreasing gas flow area reaching the minimum, or critical flow area only at a throat 56 of the nozzle 33. As shown in FIG. 3 the arc 34 extends between the stationary arcing contact fingers 46 and the movable arcing contact 54. The compressed gas 28 flows through the throat 56 longitudinally of the nozzle 33 and of the arc as well as through the vent openings 36.

In accordance with the present invention, an improved rotary motion of the arc 34 is obtained by applying a rotating magnetic field 58 as shown diagrammatically in FIG. 4. The arc 34 is subjected to a circle 60 of arc rotation which is induced by three field poles 62, 64, 66, or alternatively three field coils 68 without cores. Each field pole is encircled by energizing field coils 68 to generate a high frequency, three-phase, current flow therein. Thus the three field poles 62, 64, 66 are driven by a three-phase power supply, which produce the rotating magnetic field 58 that is transverse to the axis of the arc 34. FIG. 3 depicts the arc location in an axial gas flow similar to that occurring in axial gas blast circuit breakers. The arc conducts the current between the contacts 46, 54 with an axial compressed gas flow superimposed. Since the magnetic field 58 is required for only a short period prior to current zero, a triggered pulse power supply can be used.

Figure 8:
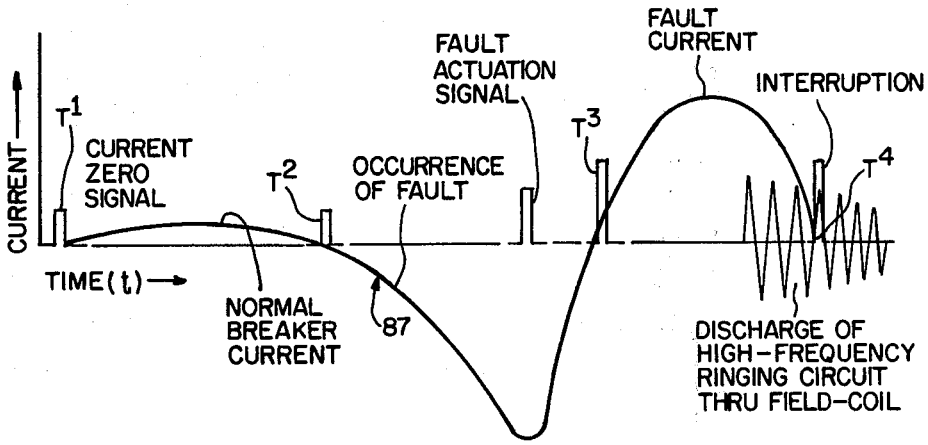
FIG. 8 is a graph of the timing sequence for one field coil.

The result of the rotating magnetic fields 58 is an arc moving in a circle about the center line of the throat 56 and within the superimposed compressed-gas axial gas flow 28. This effectively increases the periphery of the arc exposed to the axial gas flow and thereby increases the energy loss. As a result a more restricted arc having a faster thermal decay is obtained and provides the circuit interrupter with the ability to thermally recover at higher values of "di/dt" where "di" is the change of current (i) with respect to the change "dt" of time (t) (FIG. 8). Published data can be used to predict the rotational arc motion. Magnetic fluxes of 1,000 to 1,500 gauss can rotate arcs carrying current of 1,000 to 10,000 amperes at velocities of near 40 meters/second in a high pressure, sulfur-hexafluoride ($SF_6$) gas flow. Using rotating frequencies of only 1,000 Hz, the arc may typically rotate on a 1.3 cm diameter circle. Such a rotating arc action causes greater influence upon the energy coupling mechanisms to result in a more intimate engagement of the arc with the gas flow and thus effects faster circuit interruption.

An insulating ring 70 (FIG. 1) prevents welding of the contact fingers 46 to the stationary contact structure 6. The contact fingers 46 are attached to the stationary contact structure 6 in a suitable manner such as threadable means 72. The stationary contact structure 6 is paralleled by and attached electrically and mechanically to the annular main movable contact portion 44. Thus, the main closed circuit is from the stationary contact fingers 42 through the movable sleeve portion 24 and to the stationary ring contacts 49.

The present invention also comprises the addition of a rotating magnetic field to the nozzle 33 by embedding a plurality of, such as three field coils 74, 76, 78 (FIGS. 5 and 6). The nozzle 33 is comprised of a suitable insulating material, such as polytetrafluoroethylene, generally sold under the trademark "TEFLON" by the Du- Pont Co., of Wilmington, Del. The field coils, 74, 76, 78 are embedded in the movable nozzle 33 and generate the high-frequency rotating magnetic field 58 (FIG. 4) to cause arc rotation within the throat 56 of the nozzle 33.

Figure 7:
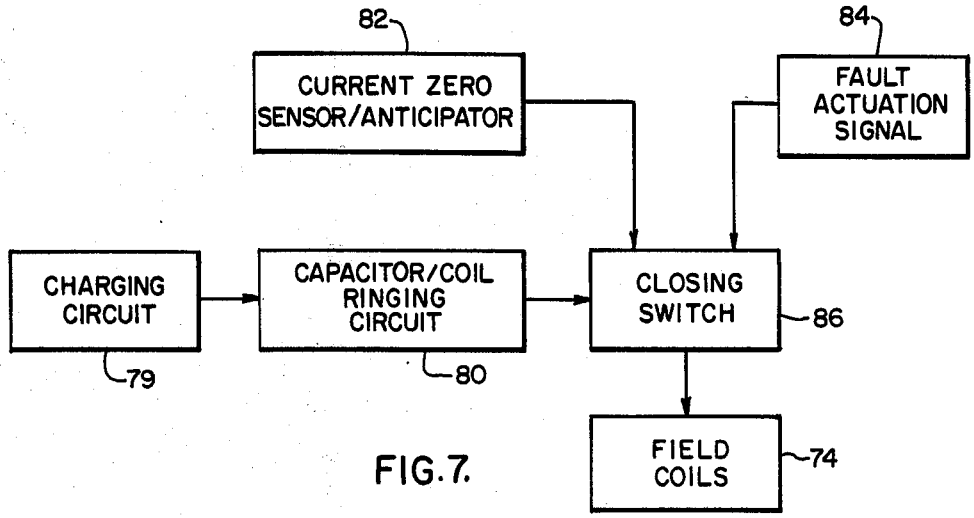
FIG. 7 is a block diagram illustrating the circuits used in conjunction with the circuit interrupter.

FIG. 7 is a block diagram indicating the circuit connections to power or energize the three field coils 74, 76, 78. The schematic block diagram indicates a charging circuit 79 that maintains a stored energy level when not operating the field coils. A ringing circuit 80 (FIG. 7) when triggered, provides a high frequency oscillating current to the three field coils. A current zero sensor/anticipator 82, provides a signal to continuously indicate when the next current zero will occur on the alternately current wave of the power current passing through the circuit interrupter, and can signal at a prescribed time prior to a current zero. A fault actuation signal 84 to indicate the circuit interrupter is operating. A closing switch 86 utilizes the fault actuation signal and the current zero sensor to perform a closing of the ringing circuit to the three magnetic field coils.

FIG. 8 is a graph of the timing sequence illustrating the locations of the current zeros as depicted by the current sensor 82 and the occurrence of a fault condition at the point 87. The graph also indicates the rise of the fault current and the interruption region in which there occurs a discharge of high-frequency ringing circuit through the three field coils, thus generating a rotative magnetic action upon the drawn arc. The rotating arc moves in a circle (FIG. 4).

Another embodiment of a nozzle structure 88 (FIG. 9) comprises a plurality of discs 90 disposed at longitudinally spaced positions and having aligned holes 92. When an arc 34 occurs between the contacts 6 and 7, the arc configuration varies in response to magnetic field conditions influencing the arc. The discs 90 absorb heat from the arc 34 and thereby hasten arc interruption.

In addition, where the circuit interrupter embodies the rotating magnetic field 58, as heretofore described in connection with FIGS. 4, 5, 6, the arc assumes a different shape. With magnetic coils a transverse normal magnetic field is generated causing an undulated or sinusoidal arc 94. The incorporation of such a magnetic field coil structure in a circuit breaker of the puffer type increases turbulence and brings about a more effective arc interruption.

Accordingly, the interruption capability of a conventional gas-blast circuit-breaker is closely linked to the turbulence in and around the arc column. Turbulence can be increased by applying a high-frequency magnetic field normal to the column axis. The interaction of the arc current and the magnetic field results in a vibrating column which increases turbulence, thus increasing energy losses with a smaller arc radius results, and finally a more rapid dielectric recovery is attained.

In conventional gas-blast circuit-breakers, a high degree of turbulence is considered essential to current interruption. Turbulence increases arc heat losses, and these losses lead to a more constricted or smaller arc, and a smaller arc can thermally decay and dielectrically recover much more quickly.

An increase in both the control and the intensity of trubulence can be realized by applying an external magnetic field of high frequency in a direction normal to the column axis. A high frequency field is generated by discharging a capacitor to provide a sufficiently high frequency and an adequate magnetic field.

Figure 9:
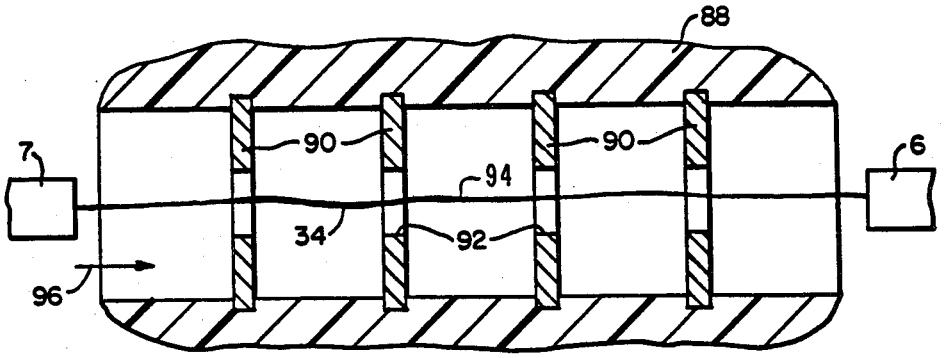
FIGS. 9–11 are diagrammatic views illustrating the principles of operation involved in the present invention.
Figure 10:
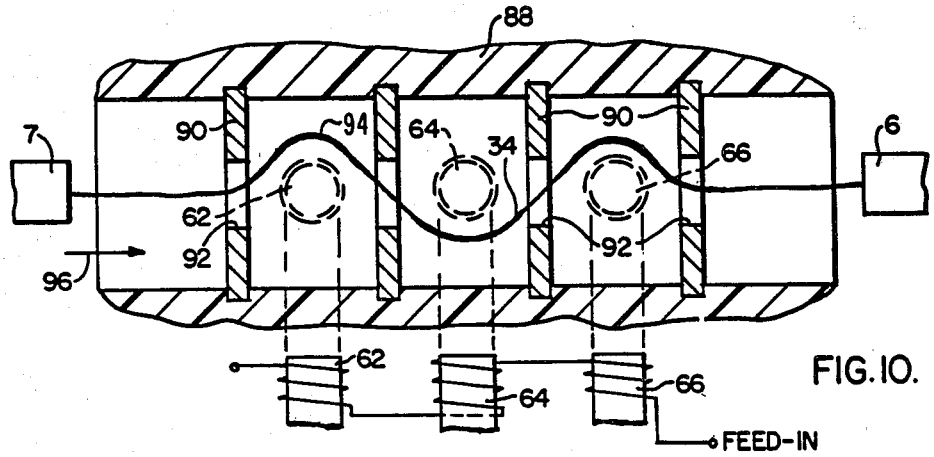
Figure 11:
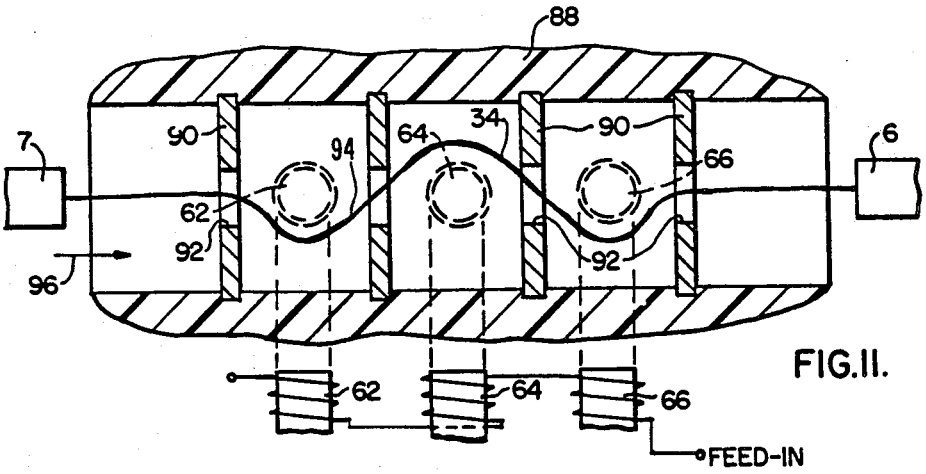

As a result of the interaction of the magnetic field with the current conducting column, the modes shown in FIGS. 10 and 11 exist. FIG. 9 represents the normal equilibrium mode, i,e. $t=0$, corresponding to zero field coil current; and FIGS. 10 and 11 are the modes a quarter period before ($t=-\frac{1}{4}\tau$) and after ($t=+\frac{1}{4}\tau$) the equilibrium point, respectively where $\tau$ is the period of magnetic field or oscillation. This oscillation is maintained until the circuit de-energizes or the column effectively ceases to carry a current.

Some possibilities of this system are (1) the spark gap can be timely ignited and (2) the capacitor could be quickly charged to provide the desired magnetic field intensity for a given fault. By controlling the amplitude of magnetic field for a given LC circuit, the optimum turbulence level could be attained.

The circuit interrupting structures illustrated in connection with the foregoing embodiments indicate that a high-frequency magnetic field of transitory duration magnetically interacts with the arc column and causes its lateral movement as well known by those skilled in the art. The left hand Fleming rule is utilized to indicate the direction of magnetic thrust on the arc current, the principles of which have been described heretofore.

It is, however, important to recognize that in the structures of FIGS. 10 and 11, there could exist by design a rotating magnetic field. At each axial station there could exist three coils with the field from each coil 120° apart in phase from the others. The number of stations may be varied. The lateral movement of the arc column is, of course, determined by the magnetic field, the frequency of the magnetic field, arc current and the condition of surrounding medium. With such an arrangement the arc at any one axial station could rotate as shown in FIG. 4.

The invention is not only applicable to a rotating magnetic field structure, but to a relatively-fixed magnetic field structure orientation which is oscillating. For both embodiments, however, it must be realized that the magnetic field is of a high frequency type of only transitory duration. In both structures however, the magnetic field is transverse or normal at all times to the arc column.

Certain features and principles of the present application are pertinent and may be used in direct-current circuits. The previous discussion was directed to alternating current circuit interruption. Although the theory regarding the interruption of a direct-current arc is somewhat different than that applicable to alternating-current circuits, where the current approaches its zero-value twice in each cycle of the alternating-current wave, nevertheless, an application of the present invention may be made to the interruption of direct-current circuits.

Specifically, there is a broad application of magnetic, induced, convection to direct-current circuit-interruption, as well as to alternating-current circuit-interruption. With particular attention being directed to FIGS. 9, 10 and 11 of the drawings, it will be noted that the modified type of interrupting structure 6, 7, 88, 90, 92 includes a plurality of spaced, washer-shaped plates 90, surrounding the arc column 34, and assisting to direct a gas flow through the apertures in the spaced metallic plates, as indicated by the gas-flow arrows 96. As before, a pair of relatively separable cooperable contacts 6 and 7 are utilized, together with a suitable operating mechanism for effecting the axial movement of the two electrodes, or contacts away from each other. For purposes of simplicity, it will be assumed that the left-hand contact is an anode contact, whereas the right-hand contact is the cathode contact. The high-current, direct-current arc is designated by the reference numeral 34, and extends generally through the center of the plurality of apertures afforded by the spaced either metallic or ceramic plates.

The use of magnetic induced convection may be applied to direct-current circuit-interruption, as with a structure set forth in FIG. 6, by the use of a rotating magnetic field or an oscillating cross-magnetic field (similar to that set forth hereinbefore in FIGS. 10–11), to increase the arc-heat losses and thus to improve the interruption of direct-current circuit-interruption, employing, in addition, a desirable gas-flow action, as indicated by the gas-flow arrows 96 (FIG. 9) of the drawings.

To effect direct-current circuit interruption, the arc voltage must be increased and maintained above the source voltage. An alternating cross-field, or a rotating magnetic field, as described previously, may be utilized in combination with an axial gas flow. This will increase the arc voltage. In addition, the washer-shaped plates, surrounding the axially oriented arc, could be used to further increase the energy losses and thus to increase the arc voltage. Although it seems reasonable to employ a magnetic field having a high frequency for alternating-current circuit-interruption, as was the case previously discussed in connection with FIGS. 1–8, when attention is directed, on the other hand, to the interruption of direct-current circuits, such a high-frequency magnetic field need not be used. It may be that a 60 Hz power supply may suffice. An embodiment of the direct-current circuit interrupter (FIG. 10) illustrates the somewhat "snaking" arc obeying the $I \times B$ forces, where I is the current and B is the magnetic field.

The DC interruption is caused by the following two energy loss interactions:

(a). Enhanced convective loss due to the arc diverting a surrounding cold gas flow, (b). the arc interacting with the metal plates 90.

The fact that the arc 34 moves into the spaced plates and out of the plates, or alternatively, in an oscillating but fixed orientation around the plates with a $3\phi$ rotating magnetic field permits cooling of the plates between arcing exposures.

With attention particularly directed to FIGS. 10 and 11 it will be observed that the direct-current interrupting structure of FIGS. 10 and 11 indicates a cross-magnetic field moving the arc from one side to the other. The magnetic field, as mentioned, is illustrated in FIGS. 10 and 11.

A rotating magnetic field, such as that arrived at via a three-phase coil system (as was the case in FIG. 4 of the drawings) will rotate the arc off center, as was indicated hereinbefore in FIG. 4 of the drawings.

If such an alternating rotating field will tend to rotate the arc off center, as indicated in FIG. 4 of the drawings, it may be that the arc in such a rotating magnetic field will move around the plates rather than in and out of the plates. This still, however, leaves time intervals for cooling of the plates by the forced gas flow. As will be apparent to those skilled in the art, this basic idea can have many configurations of nozzles, field-coils, plate materials and configuration, such as various gas compositions, etc.

As mentioned hereinbefore, FIGS. 10 and 11 can utilize a rotating magentic field, as was the case with FIG. 4, in a structure similar to that of FIGS. 10 and 11. The established arc will rotate around the plates, and possibly out of the plates leading to intensive arc cooling and a build-up of the arc voltage, leading to a arc voltage greater than the source voltage, thereby resulting in extinction of the direct-current arc in FIGS. 10 and 11.

Although there have been illustrated and described specific structures, it is to be clearly understood that the same were merely for the purpose of illustration and the changes the modifications may readily be made by those skilled in the art without departing from the spirit and scope of the invention.

What is claimed is:

1. A puffer-type compressed-gas alternating current circuit interrupter including means defining a relatively stationary hollow venting contact structure, a relatively movable contact structure comprising a movable tubular venting arcing contact having a throat portion therethrough, a movable operating cylinder carrying said movable tubular venting arcing contact and slidable over a relatively fixed piston structure to compress gas in the confined space therebetween, means for establishing a flow of compressed gas through the throat portion of said movable tubular venting arcing contact for increased arc turbulence when the contacts are opened, means defining a hollow insulating nozzle movable with said movable tubular venting arcing contact, at least one field-coil embedded in said insulating hollow nozzle structure for generating a magnetic field transversely to the established arc, and separate power means for establishing a high-frequency current flow through said field coil during the arc-interruption period of short transitory duration, whereby the established arc is moved laterally by the Lorentz force ($J \times B$) for increased arc turbulence action.

2. The combination according to claim 1, wherein a plurality of field-coils are embedded in the hollow insulating nozzle structure for creating a radial high-frequency magnetic field to cause rotation of the established arc around said cooperable separable tubular contacts.

3. The combination according to claim 2, wherein the separate high-frequency power source for the field-coils comprises a capacitor charged by a high-voltage, lower-power source and connected in series with the electrical firing device, and means are provided to effect breakdown of said spark gap during the arc-interruption period for generating the high-frequency transverse magnetic field.

4. In combination, means defining an insulating nozzle, means for establishing an arc through said insulating nozzle, means for directing a flow of arc-extinguishing gas through the nozzle adjacent the established arc therewithin, and means providing a high-frequency magnetic field oriented transversely to said arc within the nozzle and of short transitory duration for increasing the arc turbulence within the insulating nozzle.

5. In combination, means defining an insulating nozzle, means for establishing an arc within said nozzle, means for establishing a flow of compressed gas through said nozzle into intimate contact with said arc, and means for establishing a high-frequency, radial, magnetic field oriented transversely to said arc and of short transitory duration for causing arc rotation within said nozzle and consequent increased arc turbulence.

6. The combination according to claim 4, wherein a pair of separable contacts separate within said insulating nozzle to establish the arc column therewithin.

7. The combination according claim 5, wherein a pair of cooperable separable contacts separate within the insulating nozzle and establish said arc therewithin.

* * * * *